US009593499B1

(12) United States Patent
Barba, III

(10) Patent No.: US 9,593,499 B1
(45) Date of Patent: Mar. 14, 2017

(54) POOL COVER SYSTEMS

(71) Applicant: John A Barba, III, Box Elder, SD (US)

(72) Inventor: John A Barba, III, Box Elder, SD (US)

( * ) Notice: Subject to any disclaimer, the term of this patent is extended or adjusted under 35 U.S.C. 154(b) by 0 days.

(21) Appl. No.: 14/954,034

(22) Filed: Nov. 30, 2015

(51) Int. Cl.
*E04H 4/00* (2006.01)
*E04H 4/08* (2006.01)

(52) U.S. Cl.
CPC ..... *E04H 4/086* (2013.01); *E04H 4/00* (2013.01)

(58) Field of Classification Search
CPC ..... E04H 4/084
USPC ..... 4/488–513
See application file for complete search history.

(56) References Cited

U.S. PATENT DOCUMENTS 5,913,613 A * 6/1999 Ragsdale ..... E04H 4/101 4/498
6,622,318 B2 * 9/2003 Mathis ..... E04H 4/101 242/919
7,047,575 B2 * 5/2006 Last ..... E04H 4/082 160/229.1
7,780,536 B2 * 8/2010 Henry ..... A63G 3/00 4/498
8,251,832 B2 * 8/2012 Henry ..... A63G 3/02 4/498
2009/0025134 A1 * 1/2009 Stephens ..... E04H 4/101 4/498
2009/0126097 A1 * 5/2009 Kanetis ..... E04H 4/084 4/503
2011/0308003 A1 * 12/2011 Scali ..... E04H 4/082 4/498
2014/0208501 A1 * 7/2014 Black ..... E04B 1/342 4/503

* cited by examiner

*Primary Examiner* — Lori Baker
(74) *Attorney, Agent, or Firm* — Mohr Intellectual Property Law Solutions, PC

(57) ABSTRACT

A pool cover system comprises a retractable pool cover, a track, a line, a line attachment block, and a cover attachment block. The line may be fixedly attached to the line attachment block. The line attachment block may be at least partially captured within the track. The cover attachment block may be at least partially captured within the track. The cover attachment block may be fixedly attached to a first lateral edge of the pool cover. The longitudinal edge of the cover attachment block may include a saddle configured to trap the line attachment block. The line attachment the line attachment block is free of attachment to the cover attachment block.

11 Claims, 6 Drawing Sheets

POOL COVER SYSTEMS

CROSS REFERENCE TO RELATED APPLICATIONS

This application claims priority to Provisional U.S. Patent Application Ser. No. 62/098,874, filed on Dec. 31, 2014, which is hereby incorporated by reference for all purposes.

BACKGROUND

The present disclosure relates generally to pool cover systems. In particular, retractable pool cover systems operating on tracks are described.

Pool cover systems operating on tracks are used to extend and retract a pool cover over a pool. Generally, a pair tracks are mounted, one on each of two opposing sides of the pool. In conventional pool cover systems, each track retains a respective "slider" (i.e., a sliding member configured to attach to the pool cover). The sliders are configured to slide back and forth on the tracks. Each slider is attached to both the pool cover and a rope. Pulling on the rope pulls the sliders forward in the tracks, thereby extending the pool cover.

During extension of a conventional pool cover, drag on the pool cover can cause binding of the sliders as they move in the tracks. Further, imperfections due to the manufacturing and/or installation of the track (e.g., variances of the inner dimensions of the track, flaws in the orientation of one or both tracks, etc.) can cause binding of the sliders as they move through the tracks. Additionally, twisting or eccentric forces imparted on the slider via the rope may cause binding. The binding of the sliders during extension of the pool cover often leads to premature failure of the rope/slider attachment point. Thus, known pool cover systems are not entirely satisfactory for the range of applications in which they are employed.

Therefore, there exists a need for pool cover systems and devices that improve upon and advance the design of known pool cover systems. Examples of new and useful pool cover systems and devices relevant to the needs existing in the field are discussed below.

SUMMARY

The present disclosure is directed to pool cover systems. In one embodiment, a pool cover system comprises a retractable pool cover, a track, a line, a line attachment block, and a cover attachment block. The track may include a tubular channel and slot formed in the wall of the tubular channel. The tubular channel may have a long axis. The slot may be disposed parallel to the long axis. The line may be configured to extend the retractable pool cover.

The line attachment block may be configured to be at least partially captured within the tubular channel. The line may be fixedly attached to the line attachment block. The line attachment block may have a leading edge and a trailing edge. The line attachment block may be configured to slide along the long axis of the tubular channel.

The cover attachment block may have a longitudinal edge configured to be captured within the tubular channel. The cover attachment block may be fixedly attached to a first lateral edge of the pool cover. The cover attachment block may be configured to slide along the long axis of the tubular channel. The longitudinal edge of the cover attachment block may include a saddle configured to trap the line attachment block. The line attachment the line attachment block is free of attachment to the cover attachment block.

In one embodiment, a method of extending a pool cover includes applying tension to a line, the line being fixedly attached to a line attachment block of a pool cover system. The pool cover system may include the line, the line attachment block, a retractable pool cover, a track, and a cover attachment block. The track may include a tubular channel having a long axis, and a slot formed in a wall of the tubular channel, parallel to the long axis. The line attachment block may be captured within the tubular channel. The line attachment block may have a leading edge and a trailing edge. The cover attachment block may have a longitudinal edge configured to be captured within the tubular channel. The cover attachment block may be fixedly attached to a first lateral edge of the pool cover. The longitudinal edge of the cover attachment block may include a saddle configured to trap the leading and trailing edges of the line attachment block. The line attachment block may be free of attachment to the pool cover attachment block. The method may include first sliding, in response to the applying tension step, the line attachment block along the tubular channel. The method may include second sliding, in response to the first sliding step, the cover attachment block along the tubular channel, thereby extending the pool cover.

DETAILED DESCRIPTION

The disclosed pool cover systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various pool cover systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-6 a first example of a pool cover system, pool cover system 100, will now be described. Pool cover system 100 functions to extend and/or retract the pool cover via a set of tracks. Each track slidably engages a cover attachment block and a separate line attachment block. The cover attachment block attaches to the pool cover. The line attachment block securely attaches to a line. Pulling on the line causes the line attachment block to slide forward, which in turn pushes the cover attachment block forward, thereby extending the pool cover.

Pool cover system 100 addresses many of the shortcomings existing with conventional pool cover systems and devices. For example, the pool cover system 100 is less prone to binding in the track, due at least in part to the configuration of the line attachment block and cover attachment block. Thus the life of the line attachment point is extended, requiring less frequent replacement. Additionally or alternatively, the pool cover system 100 limits wear on the lagging edge of the pool cover where it is attached to the slider, thereby increasing the life of the pool cover itself.

Figure 1:
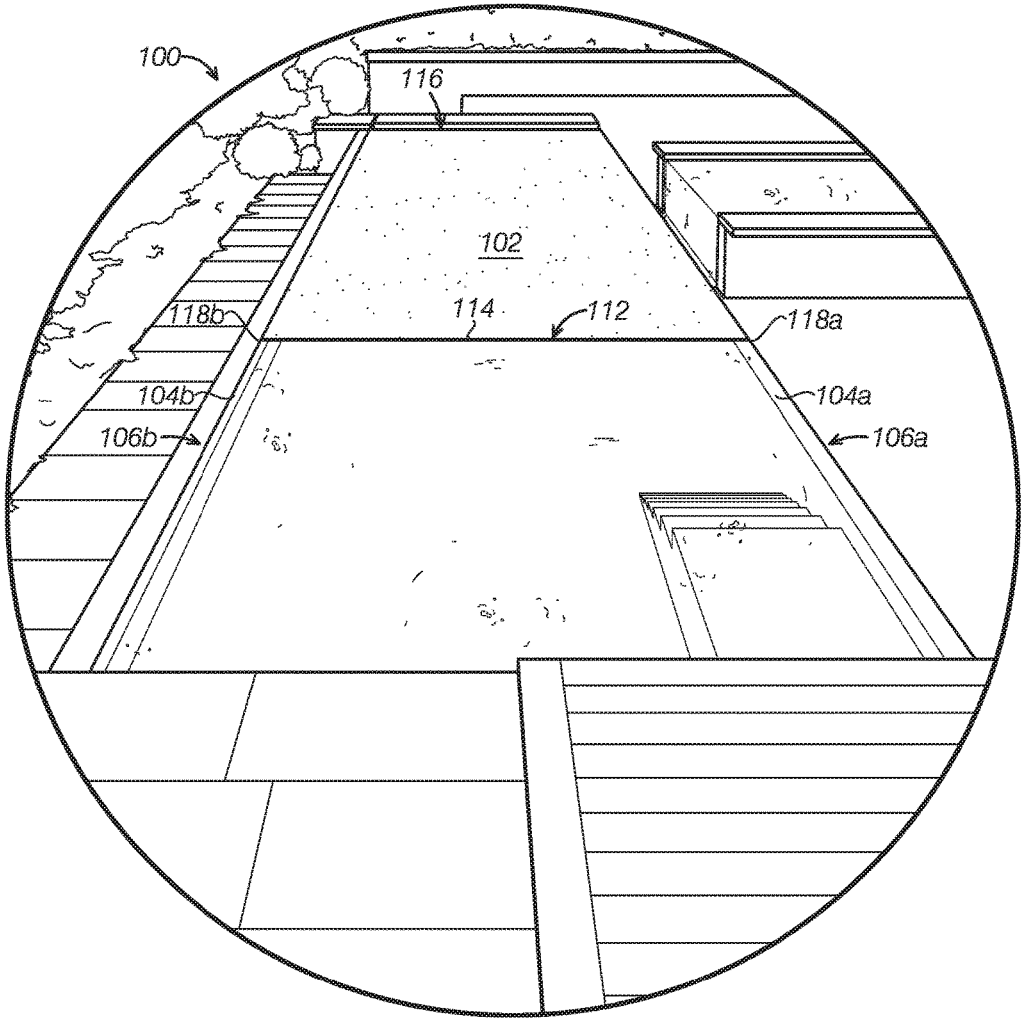
FIG. 1 is a perspective view of a first example automatic pool cover system.

As shown in FIG. 1, pool cover system 100 includes a pool cover 102 that extends and retracts along tracks 104*a* and 104*b*. Tracks 104*a* and 104*b* are embedded in or otherwise attached to opposing edges 106*a* and 106*b*, respectively, of the pool. Pool cover 102 includes opposing longitudinal edges that are attached to attachment blocks 118*a* and 118*b*, respectively. Pool cover 102 further includes a leading lateral edge 112 mounted or otherwise attached to a crossbar 114.

In some embodiments, an opposing lateral edge (not specifically shown) is coupled to a winding tube and motor, which are housed in a storage cavity 116. The pool cover may be retracted via the winding tube. In some embodiments, the pool cover system can include an above ground winding tube and motor. In some embodiments, the pool cover system can include a manual winding mechanism Turning now to FIG. 2, an exploded view of track 104, cover attachment block 118, and line attachment block 140. Line attachment block 140 is fixed to a line 142. Line attachment block 140 may include a main body 160. In some embodiments, main body 160 may be a substantially rectangular cuboidal body. Line attachment block may include a leading edge 141 and a lagging edge 143. A side bedge of attachment block 140 includes a line sleeve 154, defined by a groove in line attachment block 140.

Line sleeve 154 may be configured to securely grasp line 142. Line sleeve 154 may be configured to slide into an open end of track 104, thereby slidably engaging attachment block 140 with track 104. Furthermore, track 104 may be configured to retain the line 104.

In the present example, line attachment block 140 (i.e., main body 160 and a rope sleeve 154) comprises a durable, low-friction material (e.g., plastic, metal, etc.). In one embodiment, line attachment block 140 comprises acetal homopolymer resin, such as DELRIN.

Cover attachment block 118 may include a leading edge 150, a lagging edge 152, a longitudinal edge 166, and a grooved edge 156. Grooved edge 156 of cover attachment block 118 may be configured to slide into an open end of track 104, thereby slidably engaging attachment block 118 with track 104.

Figure 2:
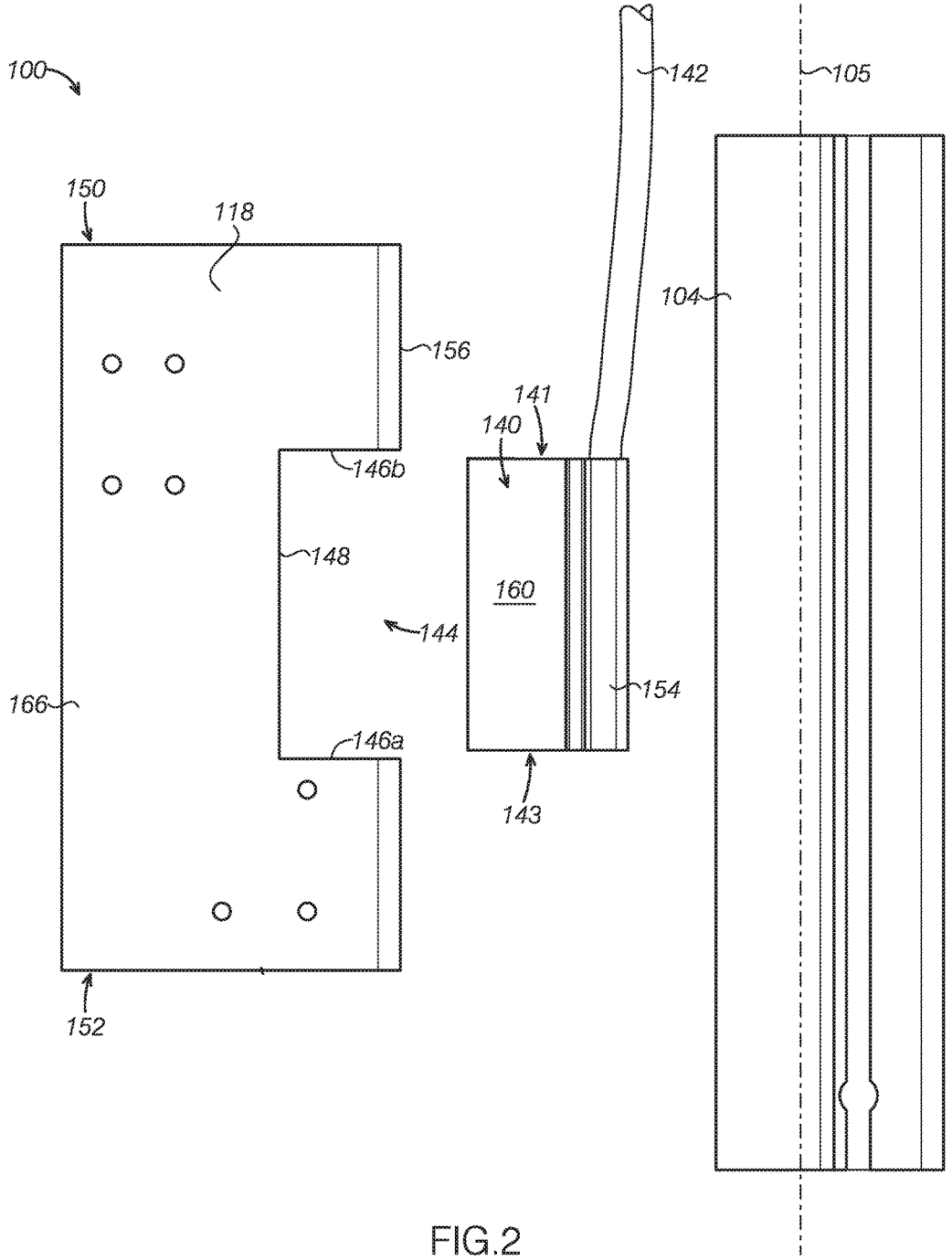
FIG. 2 is an exploded view of one embodiment of the track, line attachment block, and cover attachment block of the pool cover system of FIG. 1.

Grooved edge 156 of attachment block 118 may also include a saddle 144 defined by lagging end wall 146*a*, leading end wall 146*b* and a side wall 148. As shown in FIG. 2, line attachment block 140 may be configured to fit within saddle 144. Thus, line attachment block 140 may be placed in saddle 144 and then both the line attachment block and the cover attachment block 118 may be inserted into an open end of track 104, as shown in FIG. 3.

In the embodiment of system 100, the saddle 144 is generally rectangular in shape to match the shape of line attachment block 140. As can be appreciated, in other embodiments, the saddle and line attachment block may take on various other shapes.

In some embodiments (not pictured), the cover attachment block may be free of a saddle. In these embodiments, the cover attachment block and line attachment block may be inserted into the track such that a leading edge of the line attachment block may contact a lagging edge of cover attachment block in order to extend the pool cover.

Figure 3:
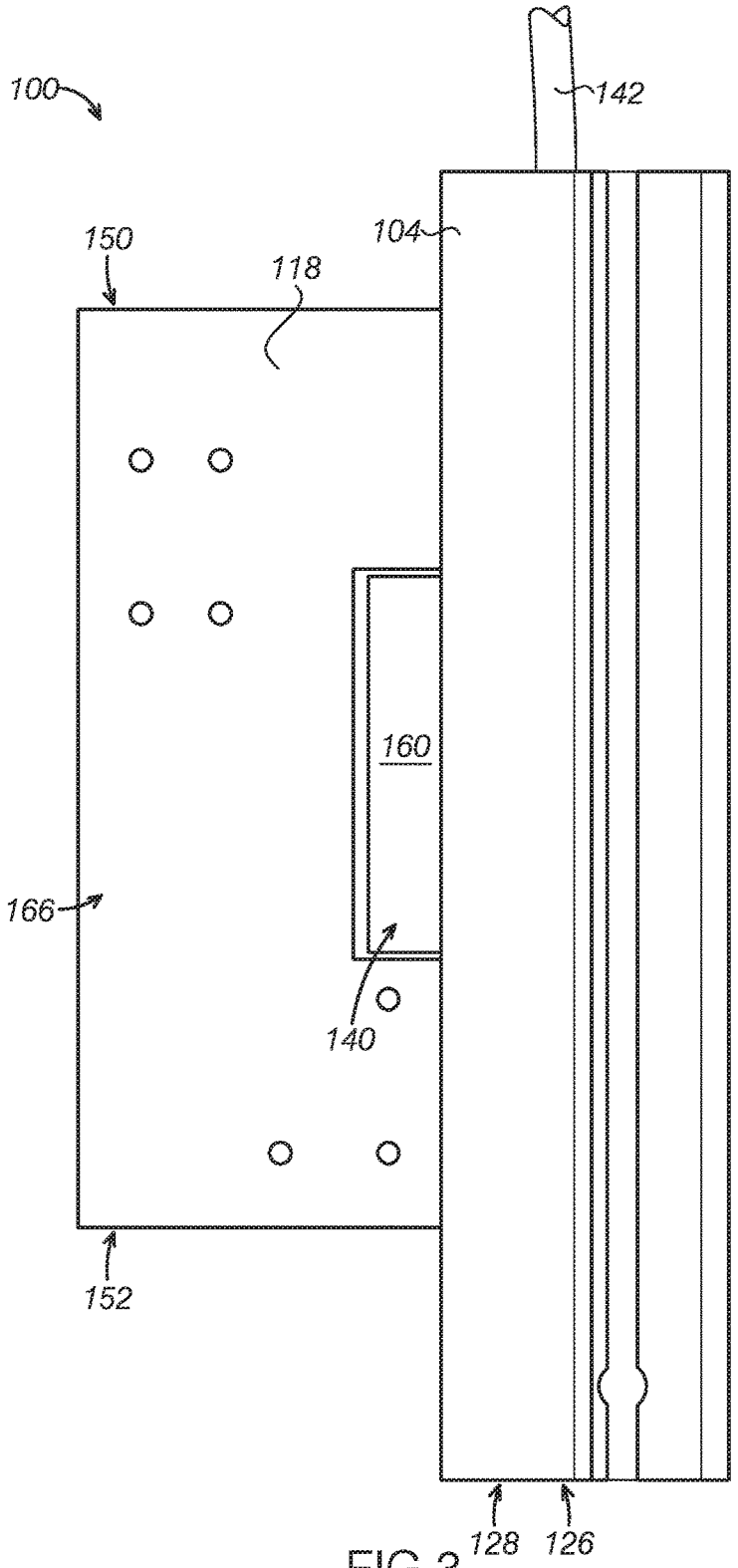
FIG. 3 is a top plan view of the track, the line attachment block, and the cover attachment block shown in FIG. 2.

FIG. 3 is a top plan view of track 104, line attachment block 140, and cover attachment block 118. Track 104 may have a long axis 105. As used herein, "long axis" means a line extending through the center of an object lengthwise. As can be seen in the embodiment of FIG. 3, line 142 may run inside the track 104, parallel to long axis 105.

When system 100 is assembled as in FIG. 3, saddle 144 may bracket both the leading and lagging edges 141, 143 of line attachment block 160 in the track 104. In this regard, pulling on line 142 (e.g., via a motorized or manual line winding device) may cause line attachment block 140 to slide forward in the track, thereby bringing leading edge 141 into contact with leading end wall 146*b* and pushing cover attachment block 118 forward. Thus, due at least in part to the decoupled nature of line attachment block 140 and cover attachment block 118, forward motion may be transferred from line attachment block 140 to cover attachment block 118 without transferring any twisting and/or eccentric forces. Therefore, system 100 may reduce or eliminate binding during pool cover extension.

Similarly, retracting pool cover 120 (e.g., via a winding tube) may cause cover attachment block 118 to slide backward in the track, thereby bringing leading end wall 146*b* into contact with leading edge 141 and pushing line attachment block 140 backward. Due at least in part to the decoupled nature of line attachment block 140 and cover attachment block 118, rearward motion may be transferred from cover attachment block 118 to line attachment block 140 without transferring any twisting and/or eccentric forces. Therefore, system 100 may reduce or eliminate binding during pool cover retraction.

Figure 4:
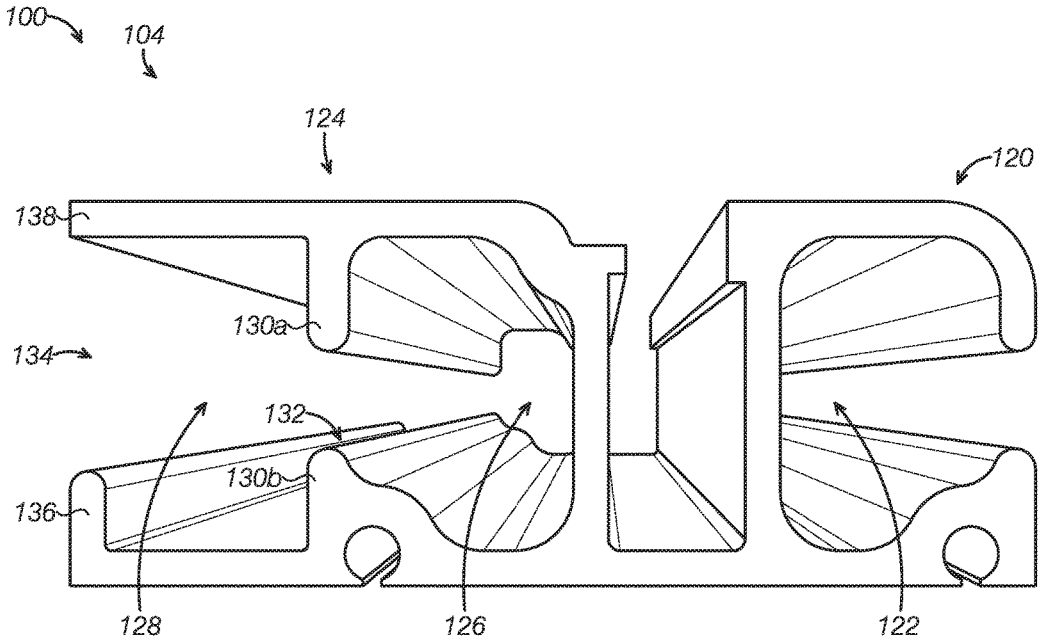
FIG. 4 is an end view of the track shown in FIG. 2.

Turning now to FIG. 4, an end view of track 104 is shown. As can be seen in FIG. 4, track 104 includes a mounting portion 120, and a first tubular channel 124. Mounting portion 120 may comprise a second tubular channel 122. It will be appreciated that in other examples the mounting portion can have any desired configuration for attachment, mounting, and/or embedding of the track into an edge of the pool.

First tubular channel 24 may include a slot 134 formed in one wall of the tubular channel. A retaining lip 136 may form a first edge of slot 134. The slot may include a second edge 138. Slot 134 may be disposed parallel to long axis 105 (extending out of page of FIG. 4). First tubular channel 124 may be divided into a line channel 126 and a block channel 128 via upper partial wall 130*a* and lower partial wall 130*b*. Upper and lower partial walls 130*a*, 130*b* may be separated by an opening 132.

Figure 5:
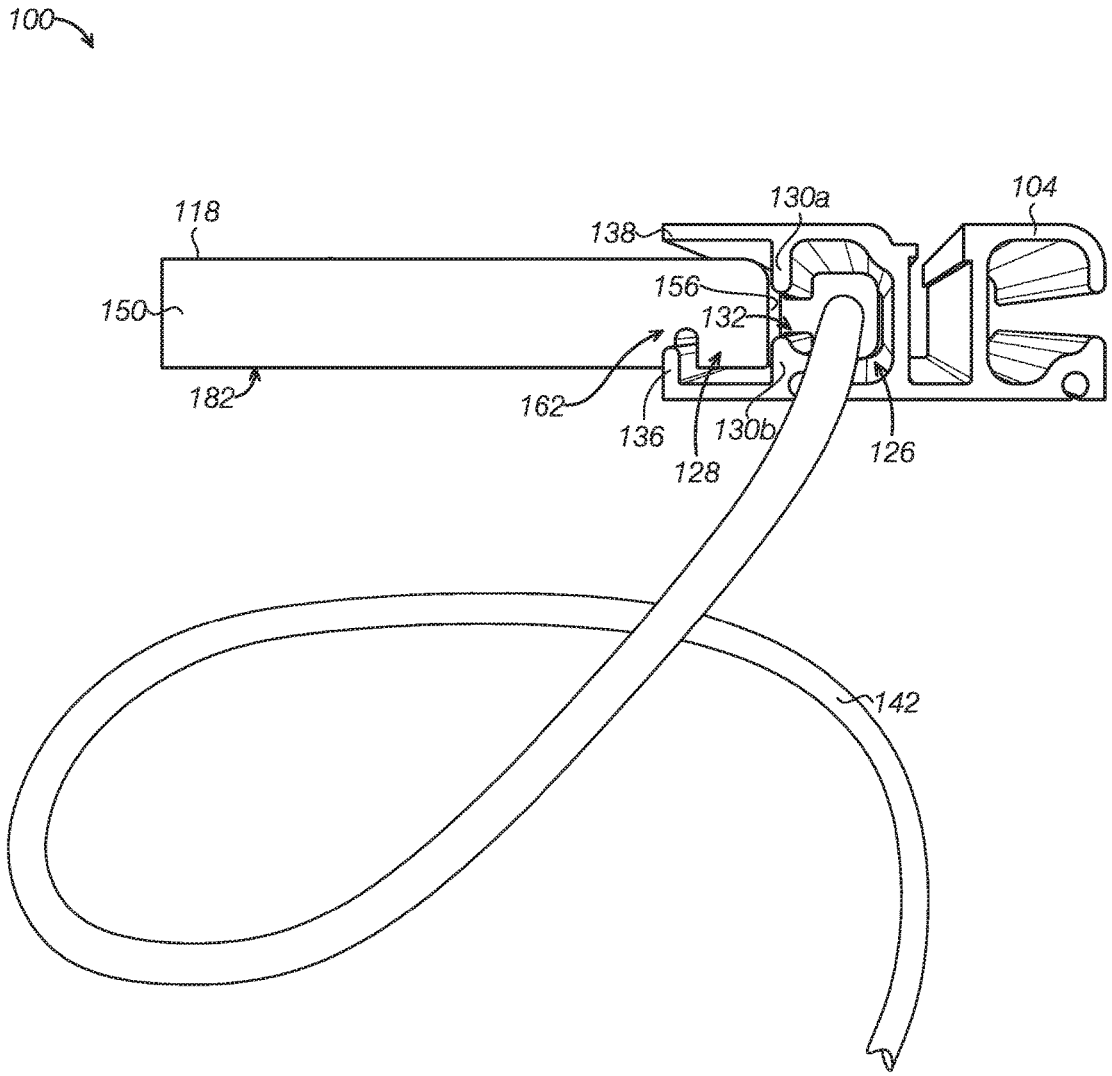
FIG. 5 is an end view of the track with the line attachment block and the cover attachment block slidably engaged therewith.

Turning now to FIG. 5, an end view of track 104, line attachment block 160 and cover attachment block 118 is shown. As can be seen, sleeve 154 of line attachment block and line 142 may be inserted into line channel 126. As can best be seen in FIG. 6, line attachment block 160 includes grooves 158*a* and 158*b*. Grooves 158*a* and 158*b* engage with partial walls 130*a* and 130*b*, respectively, so that sleeve 154 is retained in rope channel 142 as it moves through track 104. Further, a groove 164 in line attachment block 140 engages with retaining lip 136 so that main body 160 is retained in slider channel 128 as it moves through track 104. Line 142 may have a diameter that is larger than opening 132, and therefore line 142 is also retained within line channel 142 as it moves through track 104.

Longitudinal edge 156 of cover attachment block 118 may be inserted into block channel 128. In one embodiment, longitudinal edge 156 abuts partial walls 130*a* and 130*b*. Further, a groove 162 in cover attachment block 118 engages with partial wall 136 so that cover attachment block 118 is retained in slider channel 128 as it move through track 104. In the present example, grooves 162 and 164 are located in bottom surfaces 182 and 184 of the cover attachment block and the line attachment block, respectively. Additionally or alternatively, it will be appreciated that in alternate examples grooves can be included in top surfaces of the respective blocks. In these alternate examples, the track may include an additional or alternative retaining lip at the top interior edge for engaging with the additional grooves.

Figure 6:
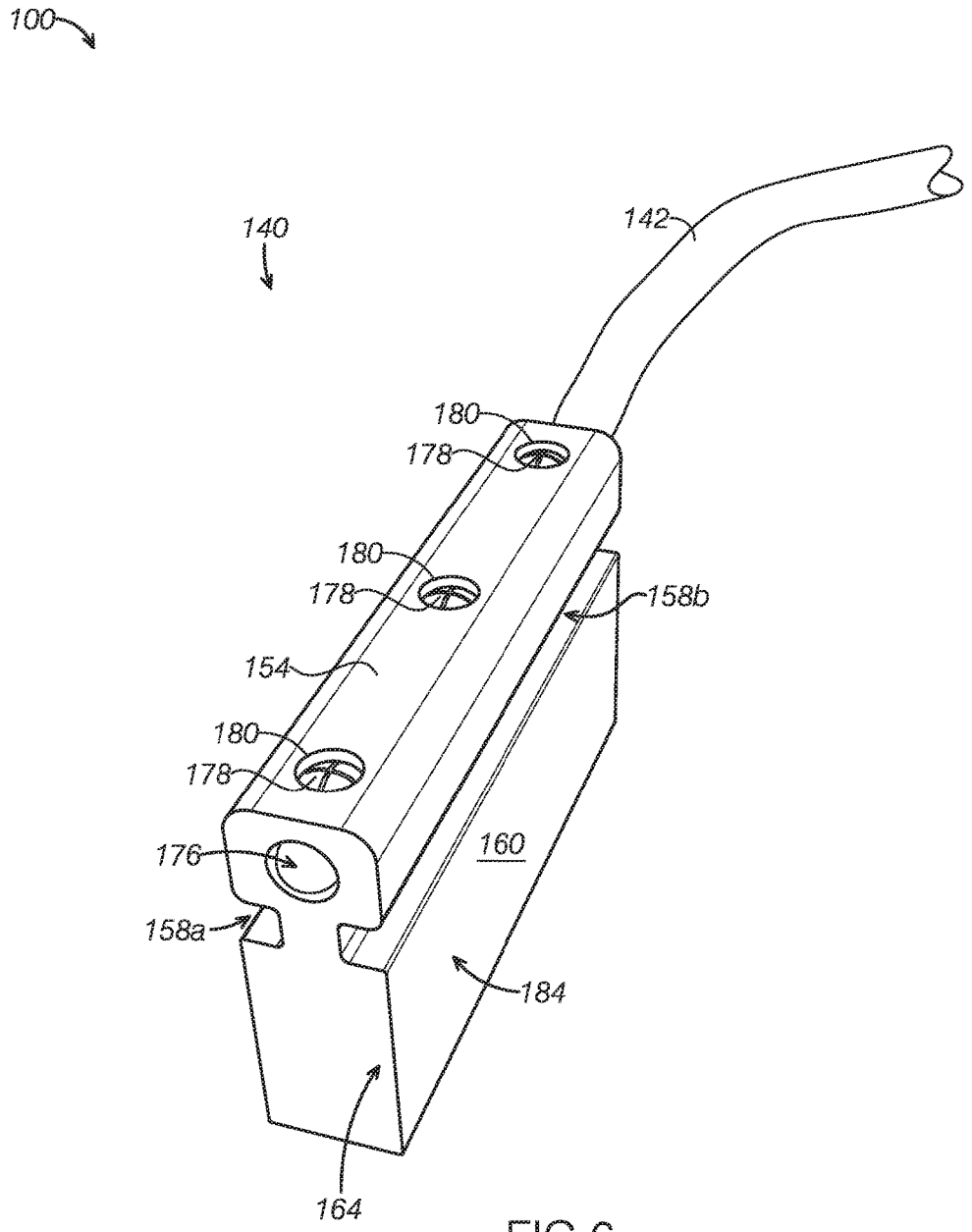
FIG. 6 is a perspective view of one embodiment of a line attachment block.

A detailed view of line attachment block 140 is shown in FIG. 6. As depicted in FIG. 6, line sleeve 154 includes a sleeve channel 176 and line 142 is inserted through channel 176. Line 142 is releasably fixed in sleeve channel 176 by fastening members 178 inserted through holes 180 and through the fibers of line 142. In the present example, the fastening members are threaded fastening members (i.e., screws). It will be appreciated that in other examples, the rope can be fixed in the rope channel via a different attachment mechanism. In one embodiment, the line is a nylon rope. In other embodiments, the line may be a metal wire or any other suitable configuration.

In one embodiment, a method of extending a pool cover includes applying tension to a line of a pool cover system. In response, the line attachment block of the pool cover may slide along the tubular channel. Then as, described above, the line attachment block may contact the cover attachment block, causing the cover attachment block to slide along the tubular channel thereby extending the pool cover.

In some embodiments, the method may include rolling the pool cover up on itself. In response the cover attachment block may slide along the tubular channel. As described above, this may bring the cover attachment block into contact with the line attachment block, causing the line attachment block to slide along the tubular channel, thereby retracting the pool cover.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A pool cover system comprising:
- a retractable pool cover;
- a track comprising:
  - a tubular channel having a long axis; and
  - a slot formed in a wall of the tubular channel, parallel to the long axis;
- a line configured to extend the retractable pool cover;
- a line attachment block configured to be at least partially captured within the tubular channel, the line attachment block having a leading edge and a trailing edge;
  - wherein the line attachment block is configured to slide along the long axis of the tubular channel; and
  - wherein the line is fixedly attached to the line attachment block;
- a cover attachment block having a longitudinal edge configured to be captured within the tubular channel;
  - wherein the cover attachment block is fixedly attached to a first lateral edge of the pool cover,
  - wherein the cover attachment block is configured to slide along the long axis of the tubular channel; and
  - wherein the longitudinal edge of the cover attachment block includes a saddle configured to trap the line attachment block; and
  - wherein the line attachment block is free of attachment to the cover attachment block.

2. The pool cover system of claim 1, wherein the tubular channel is divided into a line channel and a block channel via a first partial wall within the tubular channel.

3. The pool cover system of claim 2, wherein the line is disposed within the line channel.

4. The pool cover system of claim 2, wherein the tubular channel includes a second partial wall disposed within the tubular channel, opposite the first partial wall.

5. The pool cover system of claim 4, wherein the line attachment block includes a first groove and a second groove, and wherein the first groove is configure to mate with the first partial wall and the second groove is configured to mate with the second partial wall.

6. The pool cover system of claim 1, wherein tubular channel includes a retaining lip, the retaining lip forming an edge of the slot.

7. The pool cover system of claim 1, wherein the line attachment block includes a third groove configured to mate with the retaining lip.

8. The pool cover system of claim 2, wherein the cover attachment block includes a fourth groove configured to mate with the retaining lip.

9. The pool cover system of claim 1, wherein the line attachment block includes a sleeve formed therein, the sleeve being configured to fixedly attach the line to the line attachment block.

10. A method of extending a pool cover, the method comprising:
- applying tension to a line, the line being fixedly attached to a line attachment block of a pool cover system, wherein the pool cover system includes:

the line;

a retractable pool cover;

a track comprising:

a tubular channel having a long axis; and a slot formed in a wall of the tubular channel, parallel to the long axis;

the line attachment block, captured within the tubular channel, and having a leading edge and a trailing edge;

a cover attachment block having a longitudinal edge configured to be captured within the tubular channel;

wherein the cover attachment block is fixedly attached to a first lateral edge of the pool cover; and wherein the longitudinal edge of the cover attachment block includes a saddle configured to trap the leading and trailing edges of the line attachment block;

and wherein the line attachment block is free of attachment to the pool cover attachment block;

first sliding, in response to the applying tension step, the line attachment block along the tubular channel; and second sliding, in response to the first sliding step, the cover attachment block along the tubular channel, thereby extending the pool cover.

11. The method of claim 10 comprising:

rolling the pool cover up on itself;

third sliding, in response to the rolling step, the cover attachment block along the tubular channel; and fourth sliding, in response to the third sliding step, the line attachment block along the tubular channel, thereby retracting the pool cover.

* * * * *